US008166674B2

(12) United States Patent
Dananberg

(10) Patent No.: US 8,166,674 B2
(45) Date of Patent: May 1, 2012

(54) FOOTWEAR SOLE

(75) Inventor: Howard J. Dananberg, Bedford, NH (US)

(73) Assignee: HBN Shoe, LLC, Salem, NH (US)

( * ) Notice: Subject to any disclaimer, the term of this patent is extended or adjusted under 35 U.S.C. 154(b) by 479 days.

(21) Appl. No.: 12/534,741

(22) Filed: Aug. 3, 2009

(65) Prior Publication Data

US 2011/0023324 A1 Feb. 3, 2011

(51) Int. Cl.
*A43B 13/38* (2006.01)

(52) U.S. Cl. ..... 36/43; 36/144; 36/25 R; 36/28

(58) Field of Classification Search ..... 36/43, 44, 36/71, 80, 140, 142–145, 25 R, 28, 30 A, 36/30 R, 174, 178, 180, 182
See application file for complete search history.

(56) References Cited

U.S. PATENT DOCUMENTS

| | | | | |
|---|---|---|---|---|
| 73,924 A | | 1/1868 | Pickett | |
| 975,576 A | * | 11/1910 | Sexton | 36/43 |
| 1,055,768 A | | 3/1913 | Levee et al. | |
| 1,137,092 A | | 4/1915 | Sharp | |
| 1,210,066 A | | 12/1916 | Hara | |
| 1,387,952 A | | 8/1921 | Steinbrecher | |
| 1,480,234 A | | 1/1924 | Wedd | |
| 1,544,625 A | | 7/1925 | Austin | |
| 1,557,312 A | | 10/1925 | Lelyveld | |
| 1,728,243 A | | 9/1929 | Marshalek | |
| 1,828,086 A | | 10/1931 | Tweedie | |
| 1,847,973 A | | 3/1932 | Morton | |
| 1,957,695 A | | 5/1934 | Chiappetta | 36/71 |
| 1,960,418 A | * | 5/1934 | Schaller | 36/178 |
| 1,992,081 A | | 2/1935 | Madinger | 36/71 |
| 2,008,207 A | | 7/1935 | Greenberg | 36/71 |
| 2,029,409 A | | 2/1936 | Brand | 36/71 |
| 2,034,463 A | | 3/1936 | Dvlinsky | 36/71 |
| 2,046,732 A | | 7/1936 | Fein | 36/43 |
| 2,055,072 A | | 9/1936 | Everston | 36/28 |

(Continued)

FOREIGN PATENT DOCUMENTS

DE 22803 6/1883

(Continued)

OTHER PUBLICATIONS

"Podopediatrics—The Care of Childrens Feet" by Herman R. Tax, B.S., Pod.D., Copyright 1947 ("Manual"), pp. Forward and 101-105 and 108-110.
"A Manual of Lower Extremities Orthotics", ed. Miles H. Anderson, pp. 109-111, 1972.
"Common Foot Disorders: Diagnosis and Management", ed. Donald Neale, pp. 44-47, 52-54, 65-66, 192-194, 1981.
"Mechanical Foot Therapy", Philip R. Brachman (The Leicht Press) pp. 292-295, 1946.

(Continued)

*Primary Examiner* — Ted Kavanaugh
(74) *Attorney, Agent, or Firm* — Hayes Soloway P.C.

(57) ABSTRACT

A human shoe sole or insole, sockliner or orthotic for insertion into a human shoe having a foot supporting upper surface including a first region for supporting the first, second, third, fourth and optionally fifth metatarsal heads of the foot, and a second region surrounding the first region for supporting the remainder of the foot, at least in part. The first region provides less resistance to downward motion than the second region, and includes a hollow or depressed area relative to the remainder of the first region having a medial border portion and a lateral border portion, wherein the depression has its lowest point skewed to the medial side of center, whereby to promote eversion of the first metatarsal head as the wearer moves from midstance through propulsive phase.

42 Claims, 7 Drawing Sheets

U.S. PATENT DOCUMENTS

| | | | | | |
|---|---|---|---|---|---|
| 2,081,474 | A | | 5/1937 | Burns | 36/71 |
| 2,097,759 | A | | 11/1937 | Ehrlich | 36/71 |
| 2,119,807 | A | | 6/1938 | Farley | 36/71 |
| 2,156,532 | A | | 5/1939 | Greider | 36/2.5 |
| 2,161,565 | A | | 6/1939 | Freda | 36/71 |
| 2,252,936 | A | | 8/1941 | Leydecker | 12/142 |
| 2,255,100 | A | | 9/1941 | Brady | 36/71 |
| 2,346,279 | A | | 4/1944 | Stritter | 36/44 |
| 2,379,000 | A | | 6/1945 | Gould | 36/8.5 |
| 2,413,534 | A | | 12/1946 | Watson | 36/71 |
| 2,423,622 | A | | 7/1947 | Samblanet | 36/71 |
| 2,424,107 | A | | 7/1947 | McCahan | 36/71 |
| 2,460,493 | A | | 2/1949 | Diamant | 36/8.5 |
| 2,505,032 | A | | 4/1950 | De Voos | 36/11.5 |
| 2,628,440 | A | | 2/1953 | Leydecker | 36/71 |
| 2,658,288 | A | | 11/1953 | Scholl | 36/44 |
| 2,814,133 | A | | 11/1957 | Herbst | 36/71 |
| 2,821,032 | A | | 1/1958 | Helfet | 36/71 |
| 2,828,555 | A | | 4/1958 | Ledos | 36/71 |
| 2,897,611 | A | | 8/1958 | Schaller | 36/30 |
| 2,863,231 | A | | 12/1958 | Jones | 36/71 |
| 2,909,854 | A | | 10/1959 | Edelstein | 36/8.5 |
| 2,917,849 | A | | 12/1959 | Scholl | 36/71 |
| 2,928,193 | A | | 3/1960 | Kristan | 36/71 |
| 2,961,780 | A | | 11/1960 | McManus | 36/71 |
| 3,068,872 | A | | 12/1962 | Brody | 128/595 |
| 3,099,267 | A | | 7/1963 | Cherniak | 128/615 |
| 3,165,841 | A | | 1/1965 | Rollman | 36/2.5 |
| 3,187,069 | A | | 6/1965 | Pincus et al. | 264/45 |
| 3,233,348 | A | | 2/1966 | Gilkerson | 36/44 |
| 3,309,797 | A | | 3/1967 | Poitras | 36/80 |
| 3,333,353 | A | | 8/1967 | Garcia | 36/68 |
| 3,416,245 | A | | 12/1968 | Ferreira | 36/44 |
| 3,449,844 | A | | 6/1969 | Spence | 36/44 |
| 3,530,489 | A | | 9/1970 | Appleton | 36/44 |
| 3,591,882 | A | | 7/1971 | Pearsall | 12/146 |
| 3,638,336 | A | | 2/1972 | Silverman | 36/44 |
| 3,643,353 | A | | 2/1972 | Weight | 36/44 |
| 3,730,169 | A | | 5/1973 | Fiber | 128/2 |
| 3,781,231 | A | | 12/1973 | Janssen et al. | 260/2.5 |
| 3,842,519 | A | | 10/1974 | Lapidus | 36/44 |
| 3,847,720 | A | | 11/1974 | Laberinti | 161/159 |
| 3,935,044 | A | | 1/1976 | Daly | 156/79 |
| 4,003,146 | A | * | 1/1977 | Meier et al. | 36/44 |
| 4,054,706 | A | | 10/1977 | Shapiro | 428/213 |
| 4,055,699 | A | | 10/1977 | Hsiung | 428/311 |
| D246,551 | S | | 12/1977 | Hansjosten et al. | D2/320 |
| 4,084,333 | A | | 4/1978 | Del Vecchio | 36/43 |
| 4,101,704 | A | | 7/1978 | Hiles | 428/218 |
| 4,124,946 | A | | 11/1978 | Tomlin | 36/43 |
| 4,128,950 | A | | 12/1978 | Bowerman et al. | 36/30 |
| 4,137,654 | A | | 2/1979 | Hlavac | 36/119 |
| 4,168,585 | A | | 9/1979 | Gleichner | 36/95 |
| 4,187,621 | A | | 2/1980 | Cohen | 36/44 |
| 4,188,736 | A | | 2/1980 | Keller | 36/80 |
| 4,235,026 | A | | 11/1980 | Plagenhoef | 36/32 |
| 4,240,214 | A | | 12/1980 | Sigle et al. | 36/30 |
| 4,266,350 | A | | 5/1981 | Laux | 36/44 |
| 4,268,980 | A | | 5/1981 | Gudas | 36/43 |
| 4,272,899 | A | | 6/1981 | Brooks | 36/129 |
| 4,285,144 | A | | 8/1981 | Power | 36/44 |
| 4,292,263 | A | | 9/1981 | Hanrahan et al. | 264/469.9 |
| 4,296,053 | A | | 10/1981 | Doerer et al. | 264/26 |
| 4,302,892 | A | | 12/1981 | Adamik | 36/31 |
| 4,307,521 | A | | 12/1981 | Inohara et al. | 36/31 |
| 4,316,335 | A | | 2/1982 | Giese et al. | 36/129 |
| 4,345,387 | A | | 8/1982 | Daswick | 36/43 |
| 4,346,205 | A | | 8/1982 | Hiles | 528/53 |
| 4,346,525 | A | | 8/1982 | Larsen et al. | 36/69 |
| 4,360,027 | A | | 11/1982 | Friedlander et al. | 128/581 |
| 4,364,189 | A | | 12/1982 | Bates | 36/31 |
| 4,372,059 | A | | 2/1983 | Ambrose | 36/32 |
| 4,377,041 | A | | 3/1983 | Alchermes | 36/30 |
| 4,378,642 | A | | 4/1983 | Light et al. | 36/35 |
| 4,398,357 | A | | 8/1983 | Batra | 36/30 |
| 4,408,402 | A | | 10/1983 | Looney | 36/43 |
| 4,418,483 | A | | 12/1983 | Fujita et al. | 36/28 |
| 4,435,910 | A | | 3/1984 | Marc | 36/44 |
| 4,455,340 | A | | 6/1984 | Okina | 428/215 |
| 4,472,890 | A | | 9/1984 | Gilbert | 36/28 |
| 4,490,928 | A | | 1/1985 | Kawashima | 36/69 |
| 4,494,321 | A | | 1/1985 | Lawlor | 36/28 |
| 4,506,462 | A | | 3/1985 | Cavanagh | 36/92 |
| 4,510,700 | A | | 4/1985 | Brown | 36/44 |
| 4,510,702 | A | | 4/1985 | Ehrlich, Jr. | 36/86 |
| 4,513,518 | A | | 4/1985 | Jalbert et al. | 36/44 |
| 4,515,851 | A | | 5/1985 | Johnson | 428/246 |
| 4,517,981 | A | | 5/1985 | Santopietro et al. | 128/581 |
| 4,527,345 | A | | 7/1985 | Lopez Lopez | 36/127 |
| 4,541,184 | A | | 9/1985 | Leighton | 36/44 |
| 4,541,186 | A | | 9/1985 | Mulvihill | 36/114 |
| 4,557,060 | A | | 12/1985 | Kawashima | 36/44 |
| 4,564,966 | A | | 1/1986 | Chen | 12/146 |
| 4,581,187 | A | | 4/1986 | Sullivan et al. | 264/46.4 |
| 4,586,273 | A | | 5/1986 | Chapnick | 36/44 |
| 4,597,195 | A | | 7/1986 | Dananberg | 36/28 |
| 4,627,177 | A | | 12/1986 | Meyers | 36/43 |
| 4,627,178 | A | | 12/1986 | Sullivan et al. | 36/44 |
| 4,674,204 | A | | 6/1987 | Sullivan et al. | 36/44 |
| 4,677,766 | A | | 7/1987 | Gudas | 36/43 |
| 4,769,926 | A | | 9/1988 | Meyers | 36/43 |
| 4,777,739 | A | | 10/1988 | Hiles | 36/43 |
| 4,782,605 | A | | 11/1988 | Chapnick | 36/44 |
| 4,798,010 | A | | 1/1989 | Sugiyama | 36/30 |
| D302,764 | S | | 8/1989 | Peoples et al. | D2/318 |
| 4,854,057 | A | | 8/1989 | Misevich et al. | 36/114 |
| 4,910,886 | A | | 3/1990 | Sullivan et al. | 36/44 |
| 5,014,706 | A | | 5/1991 | Philipp | 128/581 |
| RE33,648 | E | | 7/1991 | Brown | 36/44 |
| D362,956 | S | | 10/1995 | Martin et al. | D2/961 |
| 5,509,218 | A | | 4/1996 | Arcan et al. | 36/43 |
| 5,787,610 | A | | 8/1998 | Brooks | 36/28 |
| 6,131,311 | A | | 10/2000 | Brown et al. | 36/43 |
| 6,282,816 | B1 | | 9/2001 | Rosendahl | 36/44 |
| 6,604,301 | B1 | * | 8/2003 | Manoli et al. | 36/43 |
| 7,013,583 | B2 | * | 3/2006 | Greene et al. | 36/28 |
| 7,124,520 | B2 | | 10/2006 | Galbraith et al. | 36/43 |
| 7,266,913 | B2 | | 9/2007 | Axt et al. | 36/174 |
| 7,526,882 | B2 | | 5/2009 | Rhenter | 36/174 |

FOREIGN PATENT DOCUMENTS

| | | |
|---|---|---|
| DE | 397 602 | 6/1924 |
| DE | 660551 | 5/1938 |
| DE | 875 466 | 7/1949 |
| EP | 0 427 556 | 5/1991 |
| EP | 0 591 909 | 4/1994 |
| FR | 1.163.646 | 9/1958 |
| FR | 1.207.258 | 2/1960 |
| FR | 1.413.280 | 10/1965 |
| FR | 2.015.914 | 4/1970 |
| FR | 2 272 618 | 3/1975 |
| FR | 2 309 169 | 5/1975 |
| FR | 2 427 801 | 6/1978 |
| FR | 2 506 132 | 5/1981 |
| FR | 2 522 482 | 1/1985 |
| GB | 217833 | 6/1924 |
| GB | 452492 | 11/1934 |
| GB | 1 243 575 | 8/1971 |
| GB | 1 564 195 | 4/1980 |
| GB | 2 057 964 | 4/1981 |
| GB | 2 088 776 | 6/1982 |

OTHER PUBLICATIONS

"Lower Limb Orthotics: 1981 Revision", Prosthetics and Orthotics Department, New York University, Post-Graduate Medical School, pp. 172-179, copyright 1981.

Herman R. Tax, D.P.M., "Podopediatrics", 1980, pp. 189, 221-242.

Merton L. Root, D.P.M.; William P. Orien, D.P.M.; and John H. Weed, D.P.M.; normal and abnormal Function of the Foot, 1977, Clinical Biomechanics, vol. II, pp. 355-367.

International Search Report and Written Opinion, PCT/US2010/043578, dated Sep. 24, 2010.

International Search Report and the Written Opinion, dated Jun. 27, 2011 (10 pgs).

* cited by examiner

IID
DP2
DP3
18
DD1
MP2
MP3
DP4
30
MP4
DP5
PP2
PP3
MP5
PP1
IIA
PP4
IIA
IIB
IIB
N1
N2
N3
PP5
IIC
IIC
28
42
N4
16
N5
M1
M2
M3
M4
M5
26
10
24
14
20
22
IID
12

FOOTWEAR SOLE

FIELD OF THE INVENTION

This invention relates generally to footwear and, more particularly to insoles for footwear having features that improve the comfort for the wearer during standing, walking and running.

BACKGROUND OF THE INVENTION

Footwear has undergone significant evolutionary advances in technology, particularly since the development of the electrodynogram which has permitted researchers to measure dynamic forces and to better understand biomechanical action of a human foot within a shoe while the wearer is walking or running. Using this tool, many researchers have made technological advances directed towards the mid-sole of a shoe. Since the mid-sole functions primarily as a suspension system of the sole of the foot, and often provides both protective cushioning and a stable platform for the wearer's foot, many conventional technologies have focused on cushioning the impact associated with foot strike by varying the spring coefficients in the mid-sole to dispense shock.

In my earlier U.S. Pat. No. 4,597,195 I describe a discovery of a then previously misunderstood phenomena, functional hallux limitus, that is believed to affect a majority of the population. To treat functional hallux limitus I created an improved shoe sole design which permits the first metatarsal to better achieve plantarflex relative to the great toe and remaining metatarsal heads. As explained in my aforesaid '195 patent, plantarflex allows for the extension of the human great toe during human gate cycle in an efficient fashion. More particularly in accordance with my prior '195 patent, I created a human shoe sole having an area of reduced support underlying substantially only the location of the first metatarsal head of the wearer's foot. As described in my '195 patent, providing an area of reduced support substantially only under the head of the first metatarsal encourages eversion and plantarflexion of the first metatarsal head as weight shifts from the heel to the first ray. Thus the normal functioning of the foot for plantarflexion and supination is encouraged with beneficial results for improved walking comfort and shock absorption on subsequent heel contact. Following my discovery millions of pairs of shoes have been manufactured with foot beds having an area of reduced support underlying substantially only the location of the first metatarsal head of the wearer's foot, to encourage plantarflexion of the first metatarsal head.

SUMMARY OF THE INVENTION

The present invention provides an improved insole which incorporates an area of reduced support which includes an asymmetrically shaped depression under the first metatarsal head, fashioned with its lowest point skewed to the medial side of center. This unique shape further encourages the first metatarsal head into eversion as the wearer moves from midstance to propulsive phase.

As used herein the term "sole" and "inner sole" are used interchangeably. Moreover, a "sole" or "insole" may be an element built into or forming an integral element of a footwear product such as an insole board, or as a separate element, including, e.g. a sock liner or removable insole, an aftermarket insole device, or a custom or prefabricated foot orthotic, which may be inserted into a footwear product postmanufacture. The element also may be cut into or formed in the foot supporting surface of a shoe.

In general, the improved footwear of this invention comprises a sole having a forefoot section having a first region for supporting the first, second, third, fourth and optionally fifth metarsal heads of the foot and a second region surrounding the first region, for supporting the remainder of the foot, at least in part. The first region is designed to provide less support than portions surrounding the second region. Typically, the sole is formed so that the first region is formed of a resiliently deformable material that has a lower durometer or resistance to movement than the second region. Also, in order to further promote eversion, an area of the first region underlying substantially only the first metatarsal head has a depression relative to the surrounding portion having an asymmetric shape with its lowest point skewed to the medial side of center. In other words, the depression has a shallower slope on the lateral side. This has the effect of rotating the first metatarsal head into eversion as the wearer moves from midstance to propulsive phase. The remainder of the first region preferably is flat.

BRIEF DESCRIPTION OF THE DRAWINGS

Further features and advantages of the present invention will be seen from the following detailed description, taking in conjunction with the accompanying drawings, wherein.

DETAILED DESCRIPTION OF PREFERRED EMBODIMENTS

Figure 1:
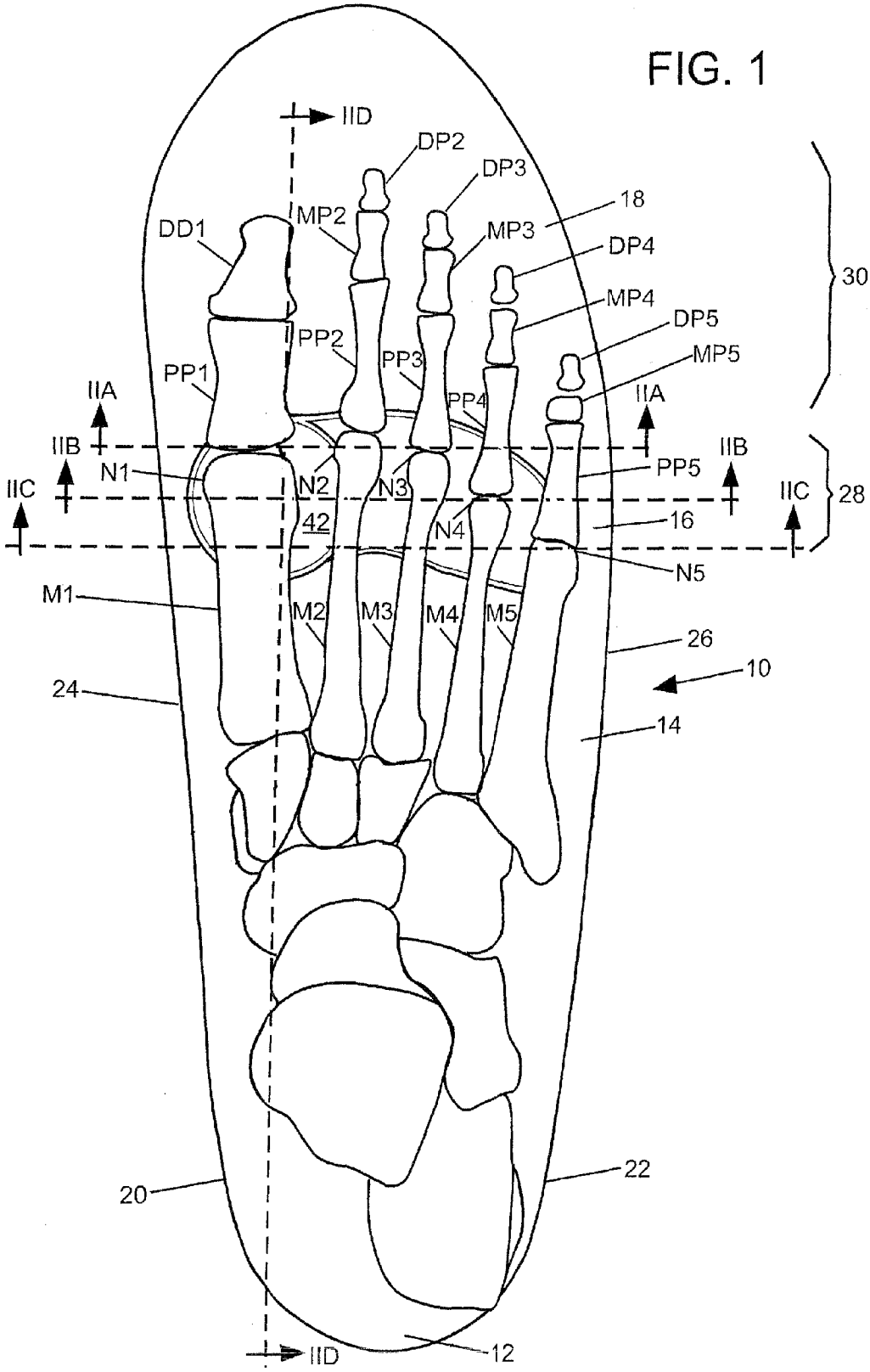
FIG. 1 is a top plan view of a sole incorporating an insert according to a first embodiment of my present invention for the right foot.
Figure 1A:
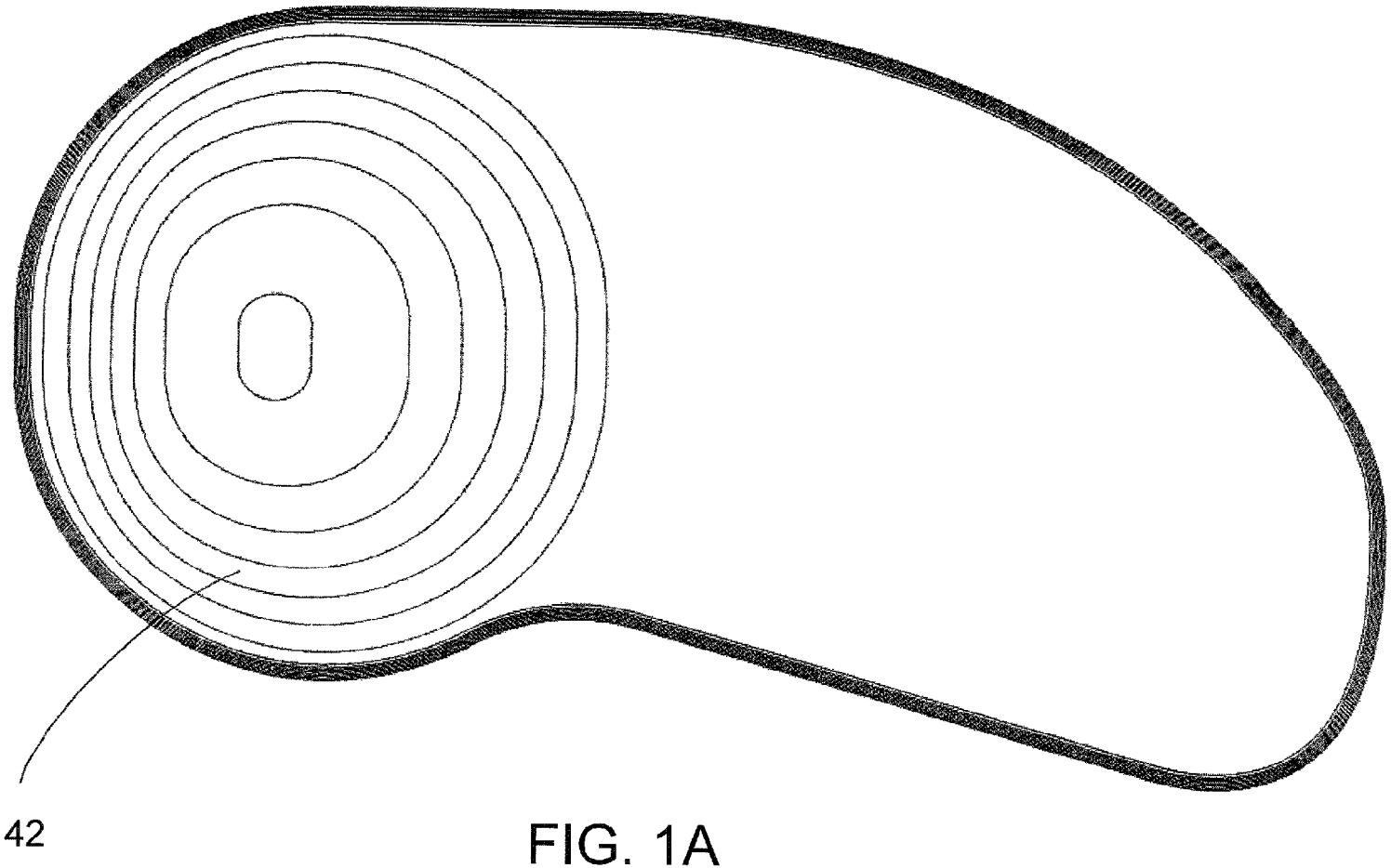
FIG. 1A is a top plan view showing details of an insert element, with contour lines taken at 0.3 cm superimposed thereon, according to the first embodiment.
Figure 2A:
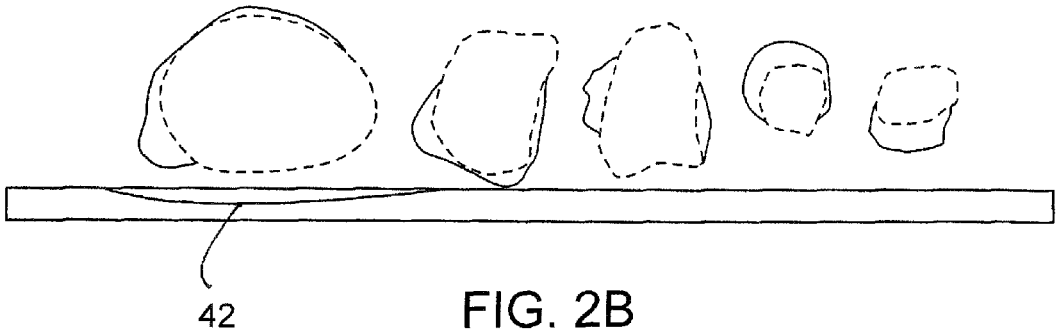
FIGS. 2A-2C are cross-sectional views taken along lines IIA-IIC of FIG. 1.
Figure 2B:
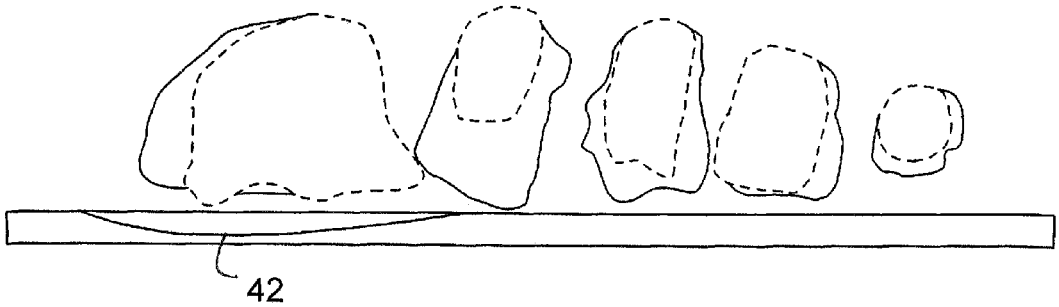
Figure 2C:
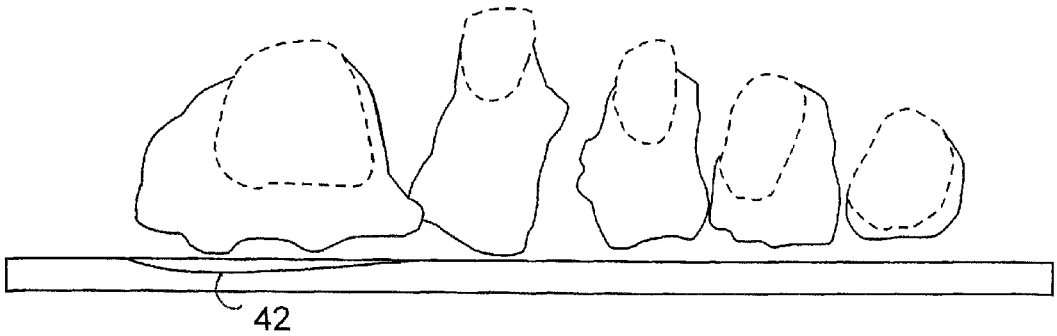
Figure 2D:
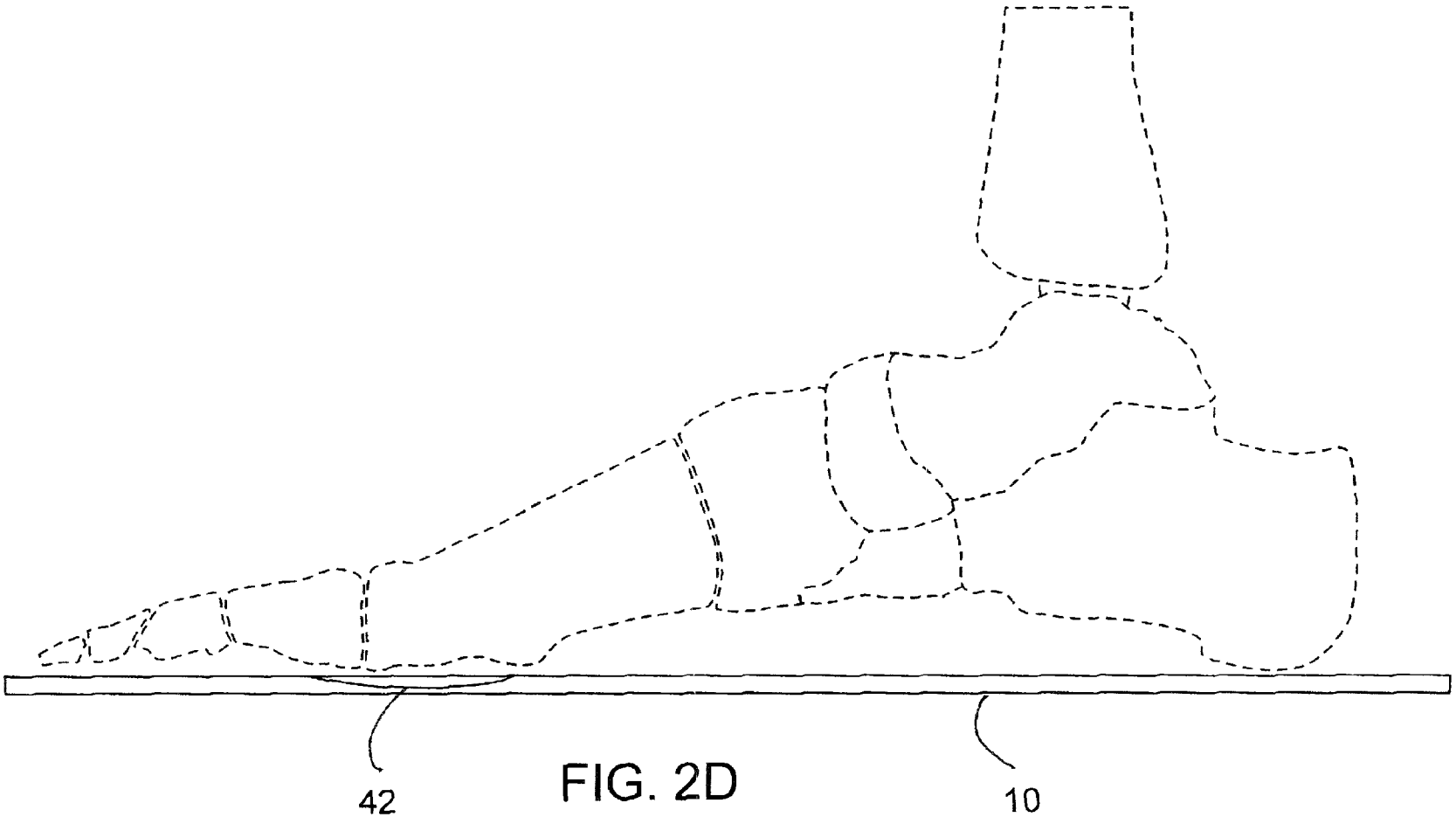
FIG. 2D is a cross-sectional view taken along lines IID of FIG. 1.

Referring to FIGS. 1, 1A and 2A-D of the drawings, footwear made in accordance with the present invention includes a sole, designated reference numeral 10, having a heel section 12, an arch section 14, a forefoot section 16 and a toe section 18, corresponding to parts of a wearer's foot. In use, the heel section 12 underlies the heel of the wearer's foot and includes medial and lateral regions designated 20, 22, respectively corresponding to the inner and outer sides of the foot. Likewise, the arch section 14 which is forward the heel section 12, underlies the arch of the wearer's foot and also includes medial and lateral regions 24, 26, respectively. The forefoot section 16 is forward the arch section 14 and includes the so-called ball of the foot which includes the first, second, third, fourth and fifth metatarsals indicated in phantom at M1-M5. The ball of the foot also includes first, second, third, fourth and fifth metatarsal heads (N1-N5) associated with the respective first, second, third, fourth and fifth metatarsal heads, and first, second, third, fourth and fifth proximal phalanges (PP1-PP5) forward of the respective first, second, third, fourth and fifth metatarsal heads, and associated metatarsal first, second, third, fourth and fifth metatarsal phalangeal joints (not labeled) between the associated metatarsal heads and proximal phalageals. The forefoot section 16 is divided into first and second regions designated 28 and 30, respectively. The first region 28 is adapted to underlie the first, second, third, and fourth metatarsal heads and optionally the fifth metatarsal head, in part, while the second region 30 is adapted to underlie the proximal phalanges (PP1-PP5), at least in part. The toe section 18 of the sole is spaced forward of the forefoot section 16 and underlies at least the middle phalanges MP2-MP5 and distal phalanges DP1-DP5 of the toe of the wearer's foot.

The sole 10 is formed so that an area of reduced support or reduced resistance to downward loading or movement is located in the first region 28 of the forefoot section 16. The first region 28 is formed of a resiliently deformable material that offers less resistance to downward movement than the region surrounding the first region, i.e. the second region 30, and also the toe section region 18. Region 28 may be formed of a material having a lower durometer than the surrounding regions 30 and 18. Preferably, region 28 will have a Shore A hardness in the range of 30-35, which closely matches the hardness of the fat pad of a typical human foot. Alternatively, region 28 may be made thinner so as to at least in part fall below the surface of the second region 30 and toe section 18. Region 28 may be formed as a separate element, e.g. a plug or insert 40 cut or built into the sole 10, or as a recess formed in the top or bottom surface of the sole, e.g. by molding or by machining. Region 28 may be covered by a flexible liner (not shown).

Also, a region within region 28, underlying substantially only the first metatarsal head of the wearer includes a hollow or depression 42, relative to the remainder of region 28, of asymmetric shape, with the lowest point of the hollow or depression skewed to the medial side of center. That is to say, as seen particularly in FIG. 1A, the hollow or depression 42 has a shallower slope on its lateral side.

In practice, depression 42 is round or nearly round in plan, and the corresponding medial and lateral walls 44 and 46 are also somewhat rounded or curved. Accordingly, as used herein, "slope" is an imaginary line or cord running between the top edge of the side wall and a point where the side wall morphs into the bottom of the depression. This is best seen by phantom line 43 (FIG. 4) which is an imaginary cross-sectional line through the midpoint of insert 40. This unique geometry has the effect of rotating the first metatarsal head of the wearer into eversion as the wearer moves from midstance to propulsive phase.

Figure 3:
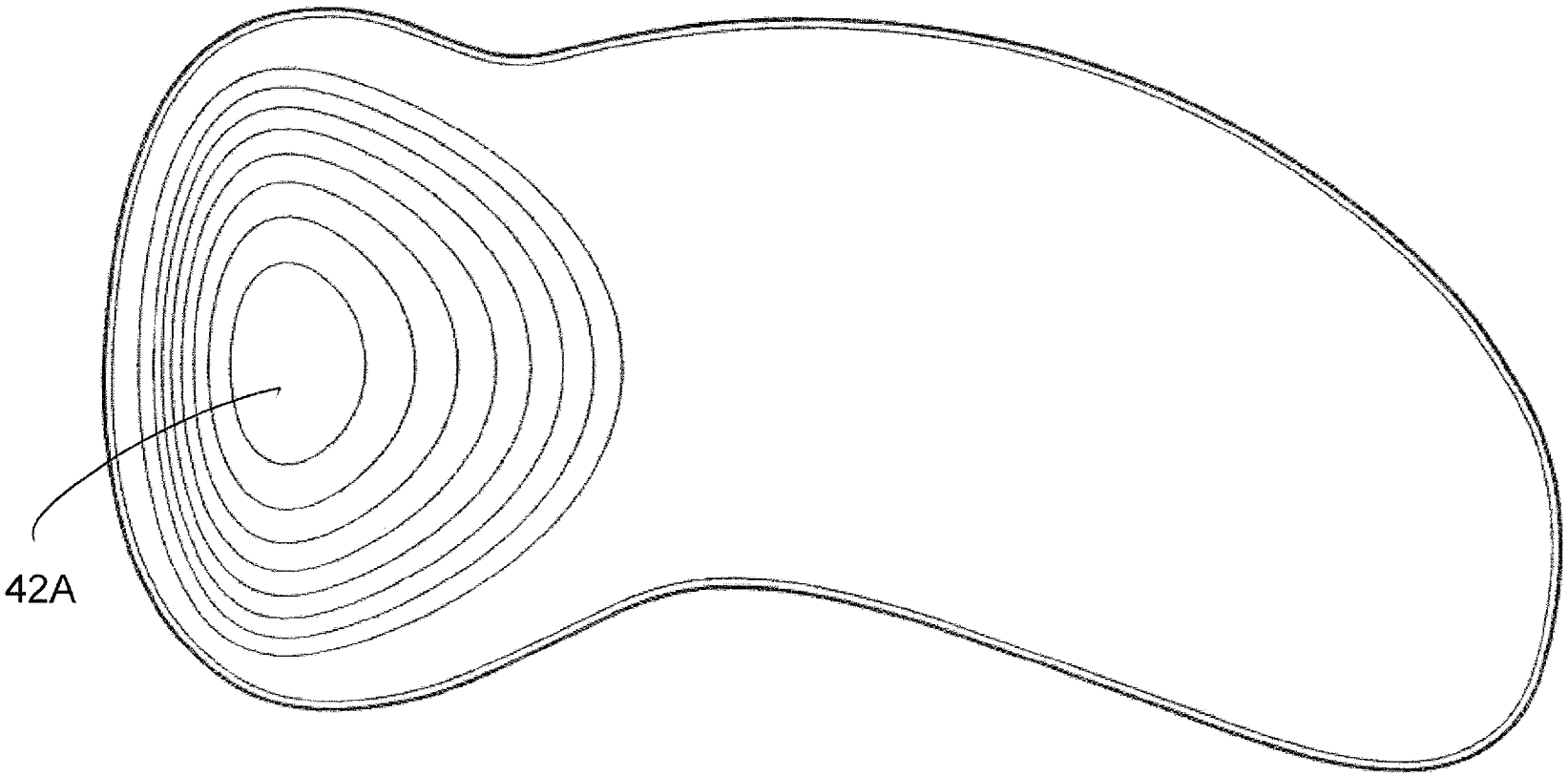
FIG. 3 is a top plan view, and FIG. 4 a transparent perspective view, with contour lines taken at 0.3 cm superimposed thereon, showing details of portions of a second embodiment of the insert element of my invention.
Figure 4:
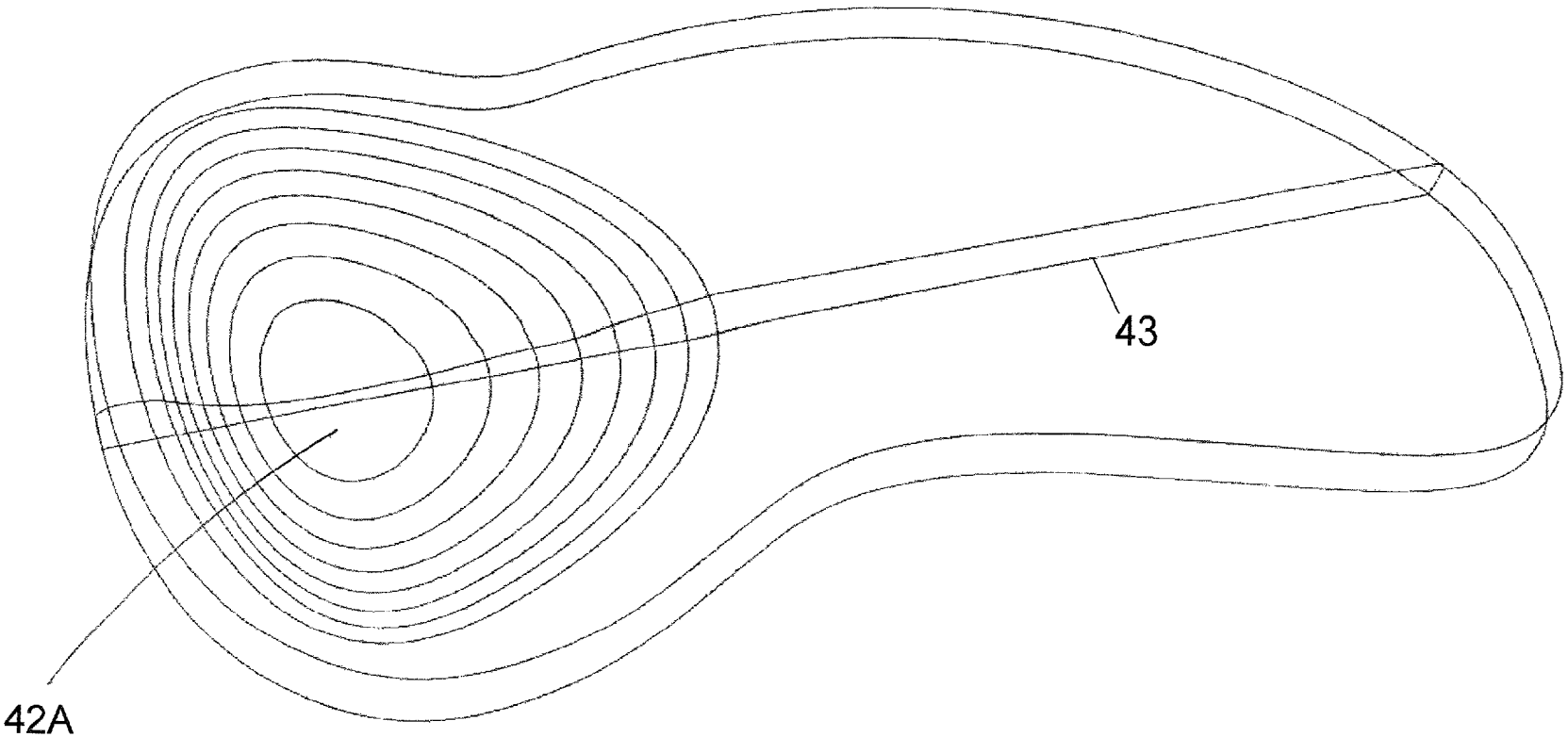

In dimensions, the hollow depression 42 should be large enough in plan to accommodate the first metatarsal head, at least in part. In a typical embodiment, depression 42 is substantially circular in plan, preferably having a diameter of about 2.54 cm. to about 3.81 cm., depending on foot size. The depression also may be oval, egg-shaped, or elongated in plan, and should have a nominal depth preferably in the range of about 2-3 mm measured from the top edge of the side walls to the lowest point of the depression. Despite this relatively small amount, this has a profound effect of rotating the first metatarsal head into eversion as the wearer moves from midstance to propulsive phase. In an alternative embodiment, the depression 42A is somewhat elongated and slightly wider at its toeward end, e.g. as shown in FIG. 3-4.

The insoles described above may be used with street and sport footwear including sandals. As noted above, the insoles may be incorporated into an insole board at the time of manufacture, formed as a sock liner or as an aftermarket insole device or a custom or prefabricated (over-the-counter) orthotic for placing into a shoe by the wearer.

Figure 5:
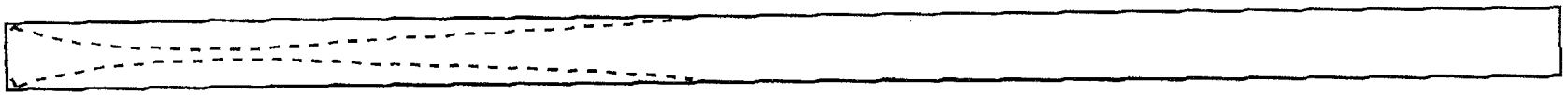
FIG. 5 is a cross-sectional view showing a third embodiment of my invention.

Various changes can be made in the above construction without departing from the scope of the invention. For example, an asymmetrically shaped hollow having tapered side walls skewed to the medial side of center may be formed extending downwardly from the bottom of an insole board or sock liner of a shoe, and underlying substantially only the first metatarsal head. Also, if desired, a device can be designed with a depression formed essentially half-way through, from side to side, e.g. as illustrated in FIG. 5, so that the device can be turned or flipped over and function as either a right or left shoe part. It is intended therefore that matter contained in the above description or shown in the accompanying drawings shall be interpreted as an illustrative and not in a limiting sense.

What is claimed is:

1. A human shoe sole having a foot supporting upper surface including a first region for supporting the first, second, third, fourth and optionally fifth metatarsal heads of the foot, and a second region surrounding the first region for supporting the remainder of the foot, at least in part, wherein the first region provides less resistance to downward motion than the second region, wherein the first region includes a hollow or depressed area relative to the remainder of the first region having a medial border portion and a lateral border portion, wherein the depression has its lowest point skewed to the medial side of center, whereby to promote eversion of the first metatarsal head as the wearer moves from midstance through propulsive phase.

2. The human shoe sole of claim 1, wherein the first region has a lower durometer than the second region.

3. The shoe sole according to claim 2, wherein the first region has a Short A hardness of 30-35.

4. The shoe sole according to claim 1, wherein the first region is formed of a plug of material surrounded by the second region.

5. The shoe sole according to claim 1, wherein the depressed area comprises an opening formed in the sole and extending from the upper surface thereof.

6. The shoe sole according to claim 1, wherein the depression comprises a hollow formed below the upper surface of the sole.

7. The shoe sole according to claim 1, wherein the depression has a normal depth of 2-3 mm measured from a top edge of a side wall to the lowest point of the depression.

8. The shoe sole according to claim 1, wherein the depression is substantially circular in plan.

9. The shoe sole according to claim 1, wherein the depression is oval or egg-shaped in plan.

10. The shoe sole according to claim 1, wherein the depression is elongated and slightly wider at its toeward end.

11. An insole for insertion into a human shoe having a foot supporting upper surface including a first region for supporting the first, second, third, fourth and optionally fifth metatarsal heads of the foot, and a second region surrounding the first region for supporting the remainder of the foot, at least in part, wherein the first region provides less resistance to downward motion than the second region, wherein the first region includes a hollow or depressed area relative to the remainder of the first region having a medial border portion and a lateral border portion, wherein the depression has its lowest point skewed to the medial side of center, whereby to promote eversion of the first metatarsal head as the wearer moves from midstance through propulsive phase.

12. The insole of claim 11, wherein the first region has a lower durometer than the second region.

13. The insole according to claim 12, wherein the first region has a Shore A hardness of 30-35.

14. The insole according to claim 11, wherein the first region is formed of a plug of material surrounded by the second region.

15. The insole according to claim 11, wherein the depressed area comprises an opening formed in the sole and extending from the upper surface thereof.

16. The insole according to claim 11, wherein the depression comprises a hollow formed below the upper surface of the insole.

17. The insole according to claim 11, wherein depression has a normal depth of 2-3 mm measured from a top edge of a side wall to the lowest point of the depression.

18. The insole according to claim 11, wherein the depression is substantially circular in plan.

19. The insole according to claim 11, wherein the depression is oval or egg-shaped in plan.

20. The insole according to claim 19, wherein the depression is elongated and slightly wider at its toeward end.

21. A sockliner for insertion into a human shoe having a foot supporting upper surface including a first region for supporting the first, second, third, fourth and optionally fifth metatarsal heads of the foot, and a second region surrounding the first region for supporting the remainder of the foot, at least in part, wherein the first region provides less resistance to downward motion than the second region, wherein the first region includes a hollow or depressed area relative to the remainder of the first region having a medial border portion and a lateral border portion, wherein the depression has its lowest point skewed to the medial side of center, whereby to promote eversion of the first metatarsal head as the wearer moves from midstance through propulsive phase.

22. The sockliner of claim 21, wherein the first region has a lower durometer than the second region.

23. The sockliner according to claim 22, wherein the first region has a Shore A hardness of 30-35.

24. The sockliner according to claim 21, wherein the first region is formed of a plug of material surrounded by the second region.

25. The sockliner according to claim 21, wherein the depressed area comprises an opening formed in the sole and extending from the upper surface thereof.

26. The sockliner according to claim 21, wherein the depression comprises a hollow formed below the upper surface of the sockliner.

27. The sockliner according to claim 21, wherein the normal depth of 2-3 mm measured from a top edge of a side wall to the lowest point of the depression.

28. The sockliner according to claim 21, wherein the depression is substantially circular in plan.

29. The sockliner according to claim 21 wherein the depression is oval or egg-shaped in plan.

30. The sockliner according to claim 29, wherein the depression is elongated and slightly wider at its toeward end.

31. An orthotic for insertion into a human shoe sole having a foot supporting upper surface including a first region for supporting the first, second, third, fourth and optionally fifth metatarsal heads of the foot, and a second region surrounding the first region for supporting the remainder of the foot, at least in part, wherein the first region provides less resistance to downward motion than the second region, wherein the first region includes a hollow or depressed area relative to the remainder of the first region having a medial border portion and a lateral border portion, wherein the depression has its lowest point skewed to the medial side of center, whereby to promote eversion of the first metatarsal head as the wearer moves from midstance to propulsive phase.

32. The orthotic of claim 31, wherein the first region has a lower durometer than the second region.

33. The orthotic according to claim 32, wherein the first region has a Shore A hardness of 30-35.

34. The orthotic according to claim 31, wherein the first region is formed of a plug of material surrounded by the second portion.

35. The orthotic according to claim 31 wherein the depressed area comprises an opening formed in the sole and extending from the upper surface thereof.

36. The orthotic according to claim 31, wherein the depression comprises a hollow formed below the upper surface of the insole.

37. The orthotic according to claim 31, wherein the depression has normal depth of 2-3 mm measured from a top edge of a side wall to the lowest point of the depression.

38. The orthotic according to claim 31 wherein the depression is substantially circular in plan.

39. The orthotic according to claim 31, wherein the depression is oval or egg-shaped in plan.

40. The orthotic according to claim 39, wherein the depression is elongated and slightly wider at its toeward end.

41. The orthotic of claim 31, wherein the orthotic is a custom orthotic.

42. The orthotic of claim 31, wherein the orthotic is a prefabricated orthotic.

* * * * *